United States Patent [19]

Golobay

[11] Patent Number: 4,501,535

[45] Date of Patent: Feb. 26, 1985

[54] VARIABLE FLOW REVERSIBLE VANE PUMP

[76] Inventor: Gary L. Golobay, 1215 Helen, Augusta, Kans. 67010

[21] Appl. No.: 417,680

[22] Filed: Sep. 13, 1982

[51] Int. Cl.[3] ..... F04C 2/00; F04C 15/02; F04B 23/00

[52] U.S. Cl. ..... 417/440; 418/78; 418/159

[58] Field of Search ..... 418/15, 159, 78, 270; 417/440

[56] References Cited

U.S. PATENT DOCUMENTS

| | | | |
|---|---|---|---|
| 2,387,761 | 10/1945 | Kendrick | 137/101 |
| 2,565,077 | 8/1951 | Holl | 417/315 |
| 2,782,724 | 2/1957 | Humphreys | 418/133 X |
| 2,899,903 | 8/1959 | Ryder | 418/258 X |
| 3,022,741 | 2/1962 | Brundage | 417/440 X |
| 3,120,814 | 2/1964 | Mueller | 418/159 X |
| 3,194,168 | 7/1965 | Rosaen | 418/132 |
| 3,451,614 | 6/1969 | Tosh | 417/440 |
| 3,515,496 | 6/1970 | Eddy | 417/440 |
| 3,799,707 | 3/1974 | Newton | 418/78 |
| 3,973,883 | 8/1976 | Walmsley et al. | 418/178 |
| 4,060,343 | 11/1977 | Newton | 418/78 |

*Primary Examiner*—John J. Vrablik
*Assistant Examiner*—T. Olds
*Attorney, Agent, or Firm*—Phillip A. Rein

[57] ABSTRACT

A variable flow reversible vane pump having a rotor with slidable vanes, a shaft providing rotary power take off for the rotor and a cam ring wherein said rotor rotates with the vanes engaging the inside of the cam ring. A case encases the cam ring and a front bearing plate connects to the front of the case. A rotary valve surrounds the shaft and flushes against the cam ring and the rotor with slidable vanes and has a structure defining a plurality of directly opposed channeled arcuate grooves, at least one port in each of the opposed grooves, and a plurality of gear teeth along part of the periphery. A rear bearing plate encloses the other end of the cam ring and the rotor and has a structure with rear plate apertures in communication with one of the opposed arcuate grooves and the port therein of the rotary valve plate. A rotatable gear is lodged within a gear channel of the case and meshes with the gear teeth along the periphery of the rotary valve plate. A central shaft is bound to the gear and externally rotates the valve plate relative to the cam ring and the rotor and the rear plate apertures. The method of the pumping with the vane pump comprises controlling externally the angular position of the rotary valve plate with respect to the fixed cam ring and the rotating rotor therein having radially slidable vanes engaging the inside of the cam ring in order to control the direction and rate of flow of the fluids through the rear plate apertures of the rear bearing plate.

1 Claim, 15 Drawing Figures

FIG. 10
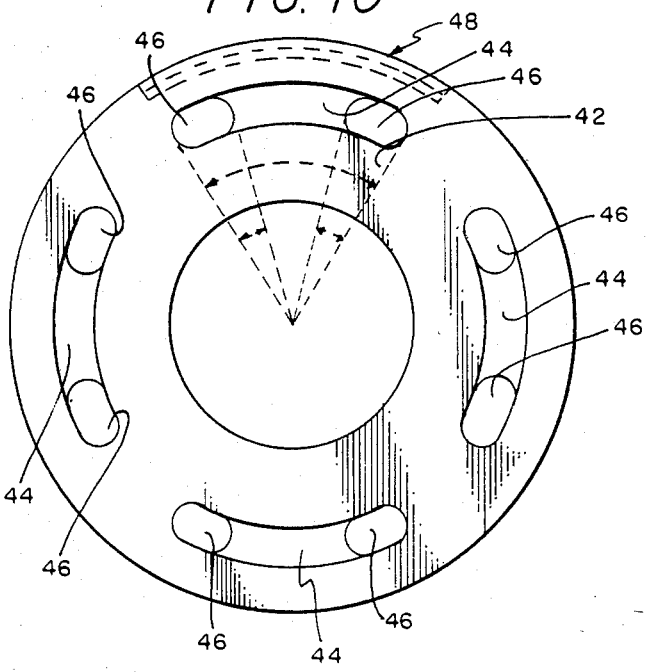
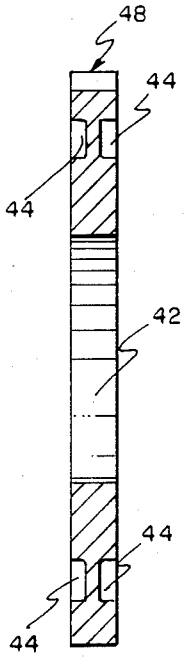
FIG. 11
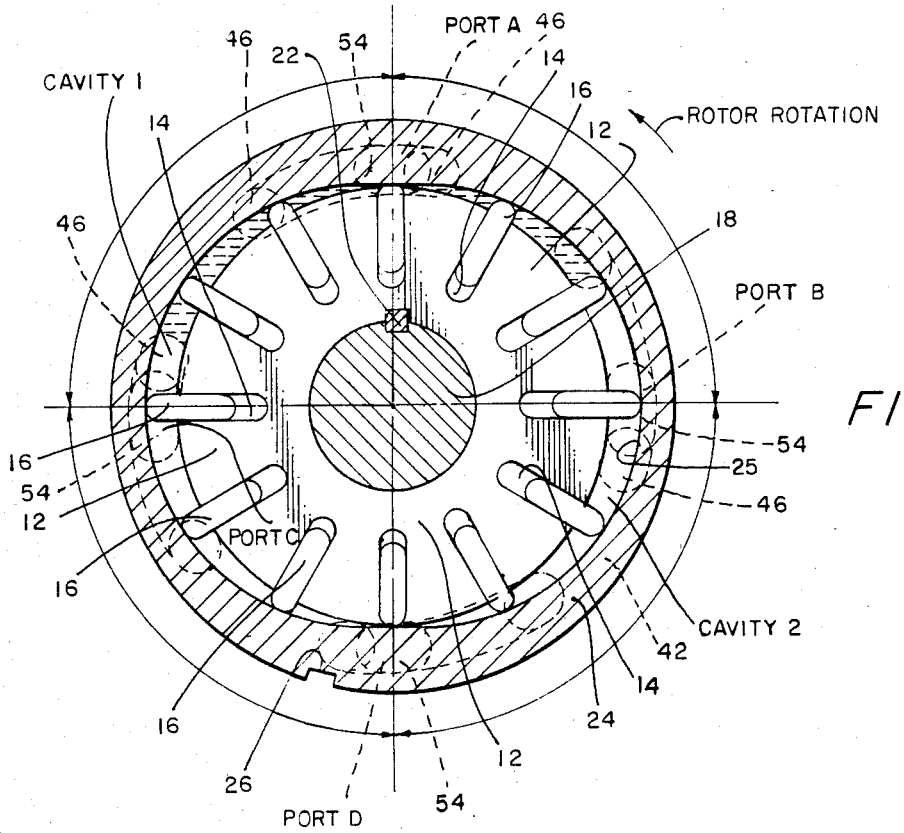
FIG. 12

VARIABLE FLOW REVERSIBLE VANE PUMP

BACKGROUND OF THE INVENTION

1. Field of the Invention

This invention is related to a vane pump. More particularly, this invention provides an improved variable flow reversible vane pump and method for pumping fluids.

2. Description of Prior Art

U.S. Pat. No. 2,387,761 by Kendrick discloses a reversible variable flow vane pump. Also, disclosures in U.S. Pat. Nos. 3,266,429 (by Stockett, Jr.), 3,717,423 (by Pedersen et al), 3,744,939 (by Grennan et al) are related to vane pumps. None of the foregoing prior art disclose the specific vane pump and method of pumping fluid of this invention.

SUMMARY OF THE INVENTION

This invention accomplishes its desired objects by providing a variable flow reversible vane pump having a rotor means including a plurality of rotor slots spacedly circumscribing the periphery of the rotor. A vane means is radially slidably positioned within each of the rotor slots and radially variably extends beyond the periphery of the rotor when biased by a force. A shaft means provides rotary power take off for the rotor. The rotor means rotates within a cam ring means including a channeled cam groove and the radially slidably positioned vane means engaging the inside of the cam ring means. A case means having a case groove encases the cam ring means and includes a structure defining a rotary valve gear channel. A front bearing plate means connects to the case means and encloses one end of the cam ring means and rotor means having the radially slidably extending vane means. A rotary valve plate means surrounds the shaft means and is flushed against the cam ring means and the rotor means having the radially slidably extending vane means and includes a structure defining a plurality of channeled arcuate grooves directly opposed to each other from each side of the rotary valve plate means and at least one port in each of the opposed grooves. A plurality of gear teeth means align part of the periphery of the rotary valve plate. A rear bearing plate means houses the end of the shaft means and connects to the case means and encloses the other end of the cam ring means and the rotor means. The rear bearing plate means has rear plate apertures in communication with at least one of the opposed arcuate grooves and including the port therein of the rotary valve plate. Gear means rotatably lodges within the rotary valve gear channel of the case means and meshes with the gear teeth means along the periphery of the rotary valve plate. A central shaft means is bound to the gear means and extends through the rear bearing plate means in order to be able to externally rotate the rotary valve plate means relative to the cam ring means, relative to the rotor means including its vane means, and relative to the rear plate apertures of the rear bearing plate. A bearing shaft retention means engages the front bearing plate means for retaining and stabalizing the shaft means as it rotates within the front bearing plate means, the rotary valve plate means and within the rear bearing plate means. The method of pumping fluid by the vane pump comprises controlling the angular position of the rotary valve plate with respect to the fixed cam ring including the rotating rotor therein having the radially slidable vanes engaging the inside of the cam ring in order to control the rate and direction of flow of the fluids through the rear plate apertures of the rear bearing plate. The method of controlling comprises rotating either clockwise or counterclockwise the valve plate.

It is an object of the invention to provide a novel vane pump which is capable of easily being assembled.

Still further objects of the invention reside in the provision of a method of pumping and a vane pump which is of variable and reversible flow and which includes a minimal of parts and is relatively inexpensive to manufacture.

These together with the various ancillary objects and features will become apparent as the following description proceeds, are attained by this invention, preferred embodiments being shown in the accompanying drawings, by way of example only, wherein:

BRIEF DESCRIPTION OF THE DRAWINGS

FIG. 10 is a front elevation view of the rotary valve plate;

FIG. 11 is a center, sectional view of the rotary valve plate;

FIG. 12 is a vertical sectional view disclosing the rotary valve plate rotated 12° counterclockwise with the rotary valve and rear ports shown as dotted lines taken along line 12—12 of FIG. 1;

DETAILED DESCRIPTION OF THE INVENTION

Figure 1:
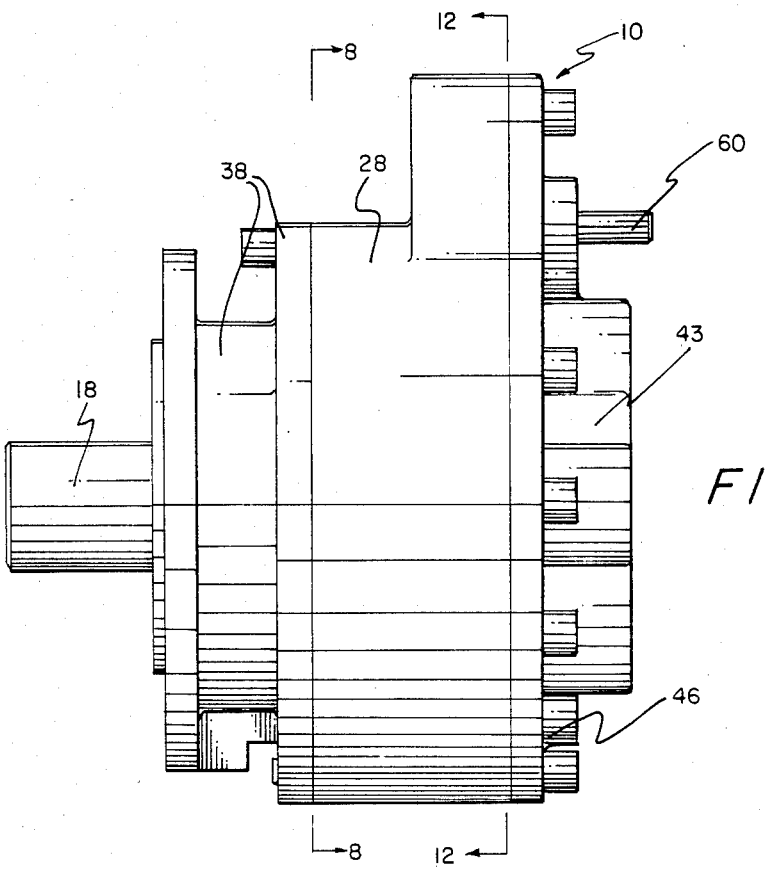
FIG. 1 is a side elevational view of the vane pump.

Referring in detail now to the drawings, wherein like reference numerals designate similar parts throughout the various views, there is seen my variable flow reversible vane pump, generally illustrated as 10, having a rotor or rotor means 12 including a plurality of rotor slots 14 spacedly circumscribing the periphery of the rotor 12. Rotor 12 is also provided with a rotor slot 13. A vane or vane means 16 is radially slidably positioned within each of the rotor slots 14 and radially variably extends beyond the periphery of the rotor 12 when biased by a force, such as centrifugal. A shaft or power take off means 18 is provided having a shaft groove 20.

A key 22 lodges in the shaft groove 20 and in the rotor groove 13 to affix the shaft 18 and the rotor 12 together and to provide rotary power take off for the rotor 12 from the shaft 18.

The vane pump 10 also includes a cam ring or cam ring means 24 having a cam groove 26. The internal surface 25 that engages the vanes 16 is of an elongated, circular shape. The rotor 12 rotates within the cam ring 24 with the radially slidably positioned vanes 16 of the rotor 12 engaging the inside of the cam ring 24 as illustrated in FIGS. 12–15.

A case 28 has a case or case means groove 30 and encases the cam ring 24. Case 28 includes a rotary valve gear channel 32 (see FIG. 3) and a case control shaft channel 34 diametrically smaller than the rotary valve gear channel 32. A key 36 lodges in the cam groove 26 and in the case groove 30 for stationarily holding the case 28 and the cam ring 24 together.

Figure 3:
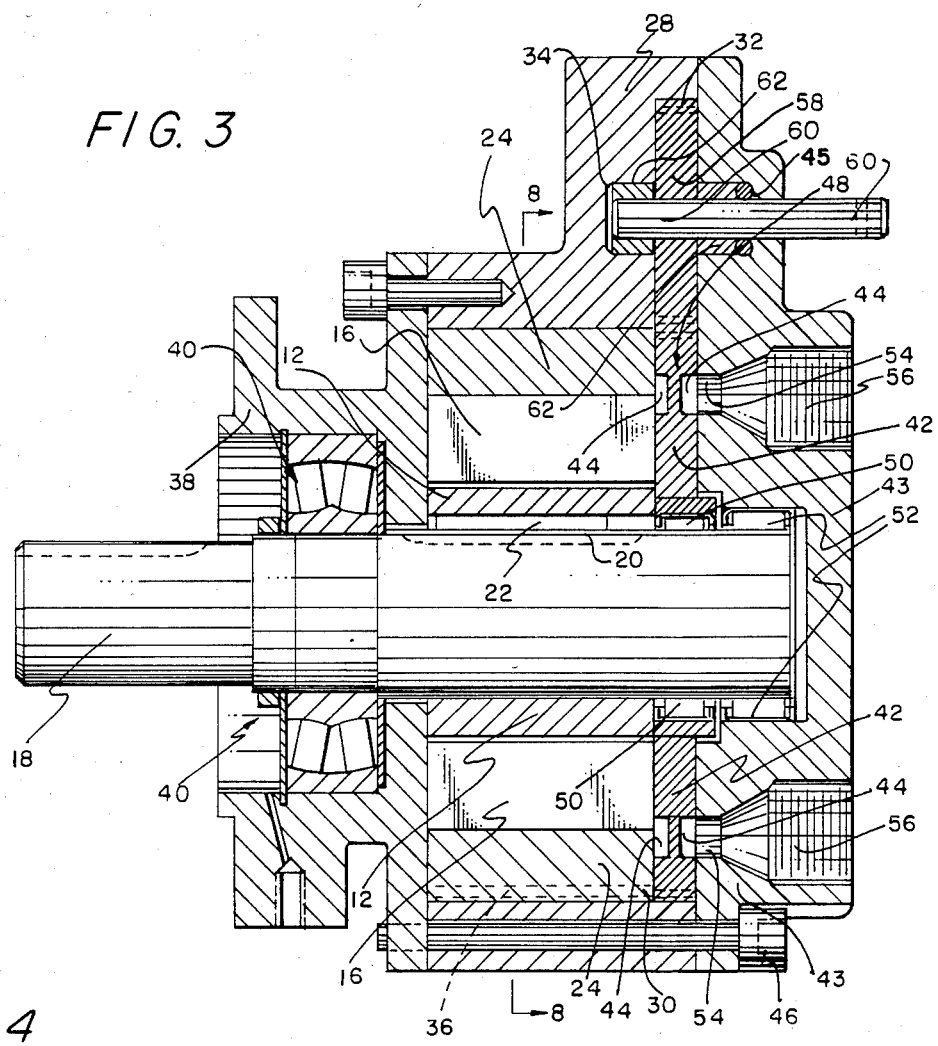
FIG. 3 is a vertical, partial sectional view of the vane pump taken along line 3—3 of FIG. 2.
Figure 4:
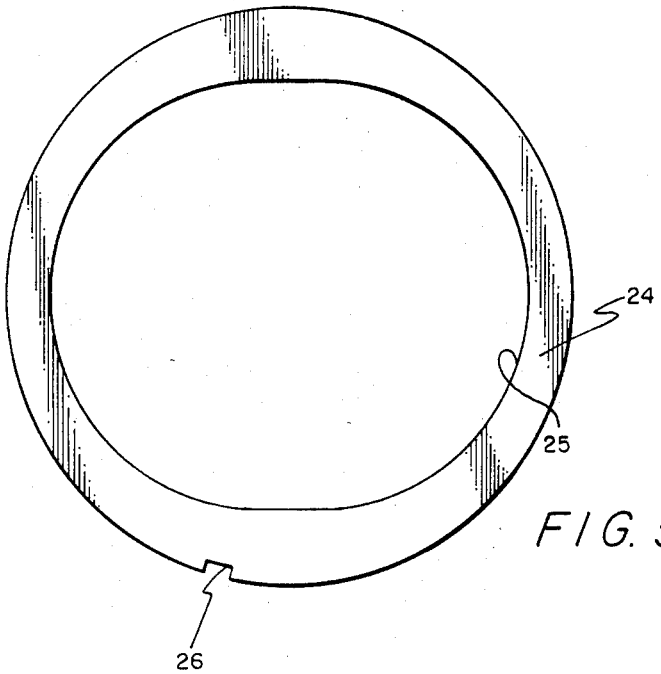
FIG. 4 is a part elevational view of the cam ring.
Figure 5:
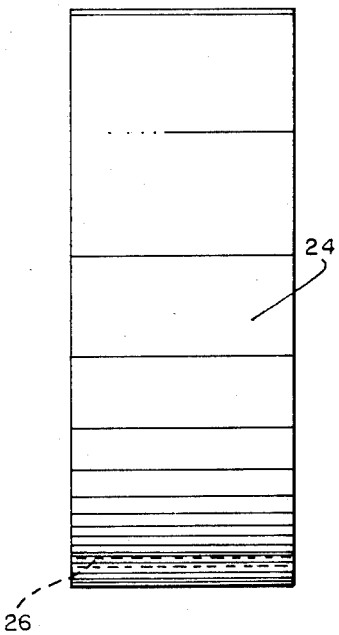
FIG. 5 is a side elevational view of the cam ring.
Figure 6:
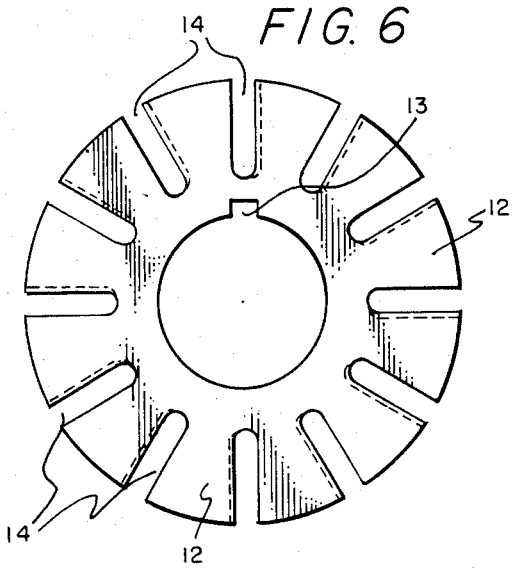
FIG. 6 is a front elevational view of the rotor.
Figure 7:
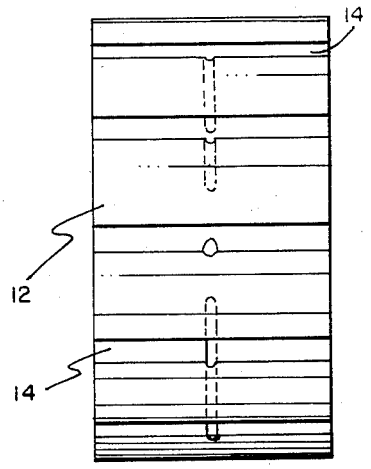
FIG. 7 is a side elevational view of the rotor.
Figure 8:
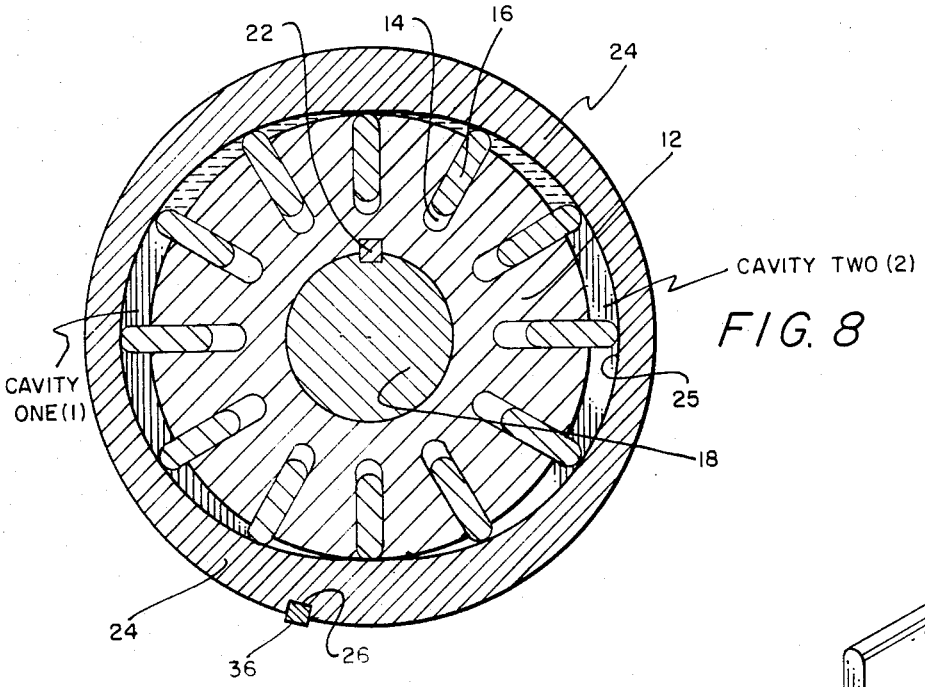
FIG. 8 is a vertical, sectional view of the rotor with the slidably positioned vanes within the rotor slots lodged against the inside surface of the cam ring with the vane pump in a balanced position due to the neutral position of the valve plate, and taken on line 8—8 of FIG. 3.
Figure 9:
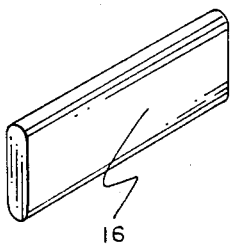
FIG. 9 is a perspective view of a vane.

A front bearing plate or plate means 38 connects to the case 28 and encloses, as illustrated in FIG. 3 one end of the cam ring 24 and the rotor 12 having the radially slidably disposed vanes 16 along the periphery thereof. A bearing shaft retention means, generally illustrated as 40 and well known in the art, engages the front bearing plate 28 for retaining and stabalizing the shaft 18 as it rotates within the front bearing plate 38 and a rotary valve plate 42 and within a rear bearing plate 43 attached to the case 28 by bolts 46.

Rotary valve plate or plate means 42 (see FIG. 10) surrounds the shaft 18 and is flushed against the cam ring 24 and the rotor 12 including its radially slidably extending vanes 16 disposed around its periphery, all as illustrated in FIG. 3. Rotary valve plate 42 has a structure defining a plurality of channeled arcuate grooves 44 directly opposed to each other from each side of the rotary valve plate 42, as clearly illustrated in FIG. 11. These grooves are located in the rotary valve plate 42 such that they overlap completely cavity (1) and cavity (2) in the radial direction. In a preferred embodiment of the invention the rotary valve plate 42 has four (4) arcuate grooves 44 on each side of the structure thereof, and the four (4) grooves 44 on one side are directly opposed to the four (4) grooves 44 on the other side of rotary valve plate 42. Each pair of opposed grooves 44—44 has a pair of ports 46–46 positioned in the extreme ends of the grooves 44—44. Preferably, the four (4) opposed arcuate grooves 44—44 on each side of the structure of the rotary valve plate 42 define an approximately 65 degree arc and each port 46 within the grooves 44 is arced approximately 17½ degrees, all with respect to the center of the rotary valve plate 42 and as further illustrated in FIG. 10. Rotary valve plate 42 additionally comprises a plurality of gear teeth, generally illustrated as 48, along part of the periphery thereof (see FIG. 10). A bearing 50 is positioned between the shaft 18 and the rotary valve plate 42.

Figure 2:
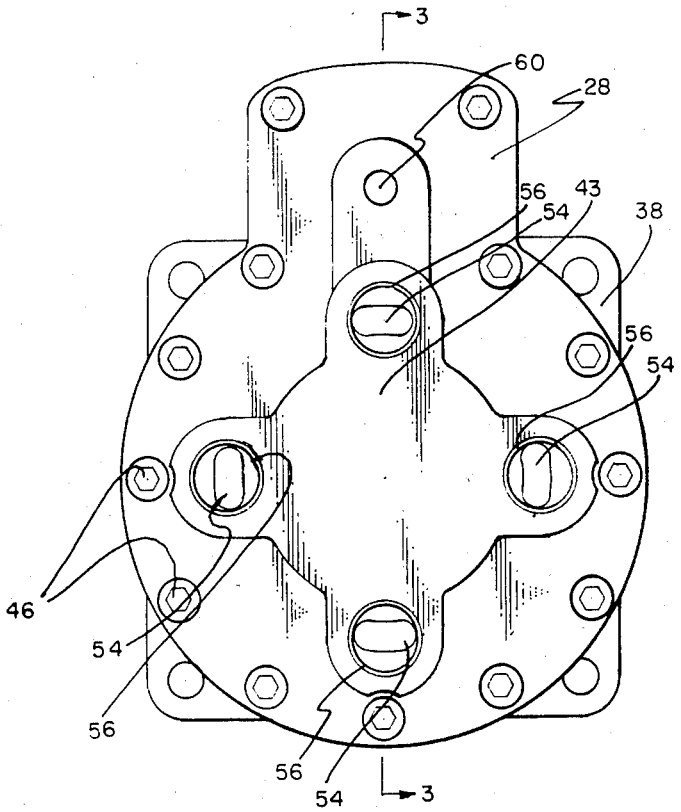
FIG. 2 is an end elevational view from the port end of the vane pump.

The rear bearing plate or plate means 43 houses the end of the shaft 18 which rotates within a bearing 52 lodged therein, as illustrated in FIG. 3, and has a rear plate control shaft channel 45 diametrically equivalent to the case control shaft channel 34. Rear bearing plate 43 encloses the other ends of the cam ring 24 and the rotor 12 with its radially slidably extending vanes 16. As can readily be seen in FIGS. 2 and 3 the rear bearing plate 43 has rear plate apertures 54 which are in communication with at least one of the opposed arcuate grooves 44 (including the port 46 therein) of the rotary valve plate 42. In a preferred embodiment of the invention, the rear bearing plate 43 comprises four (4) rear plate elongated (or generally elliptical) apertures 54 equidistantly positioned with respect to each other and each generally communicating with one of the four (b 4) pair of opposed arcuate grooves 44—44 on the rear side of the rotary valve plate 42 (see FIG. 3). The elongated apertures 54 are quite similar in shape and size to ports 46 within grooves 44—44 and each preferably define an approximately 22 degree arc with respect to the center of the rear bearing plate 43. One pair of the elongated apertures 54—54 are opposed to each other on the horizontal axis of the rear bearing plate 43, and the other pair of elongated apertures 54—54 are also opposed to each other but are positioned on the vertical axis of the rear bearing plate 43. All four (4) elongated apertures 54—54—54—54 flange outwardly into circular rear plate threaded apertures 56—56—56—56 (see FIG. 3) to provide threadable connection points wherethrough fluid passes from and into the vane pump 10 in operation of the invention.

A gear or control means 58 rotatably lodges within the rotary valve gear channel 32 of the case 28 and meshes with the gear teeth means 48 along the periphery of the rotary valve plate 42. A control shaft 60 is bound to gear 58 and extends through the rear plate control shaft channel 45 and into the case control shaft channel 34 while being surrounded in each of the channels 34, 45 by a control shaft bearing means 62, and in operation of the invention as explained hereinafter, rotates the rotary valve plate 42 relative to the rotor 12 including its vanes 16; and finally relative to the rear plate apertures 54 of the rear bearing plate 43.

Figure 13:
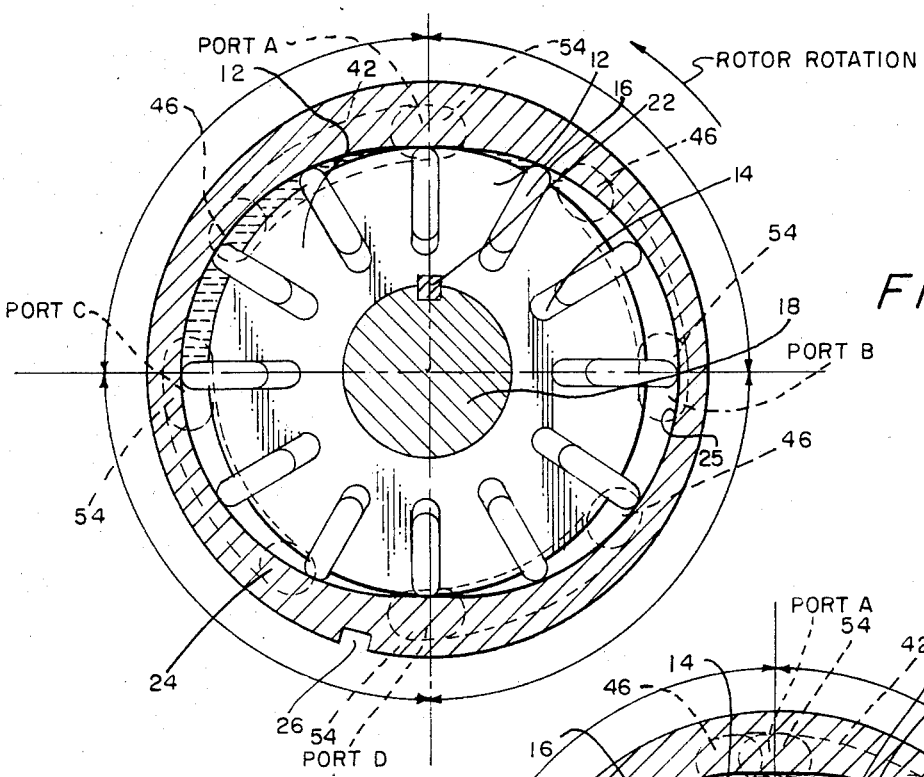
FIG. 13 is a vertical sectional view disclosing the rotary valve plate rotated at full counterclockwise position and the vane pump operating at full flow.
Figure 14:
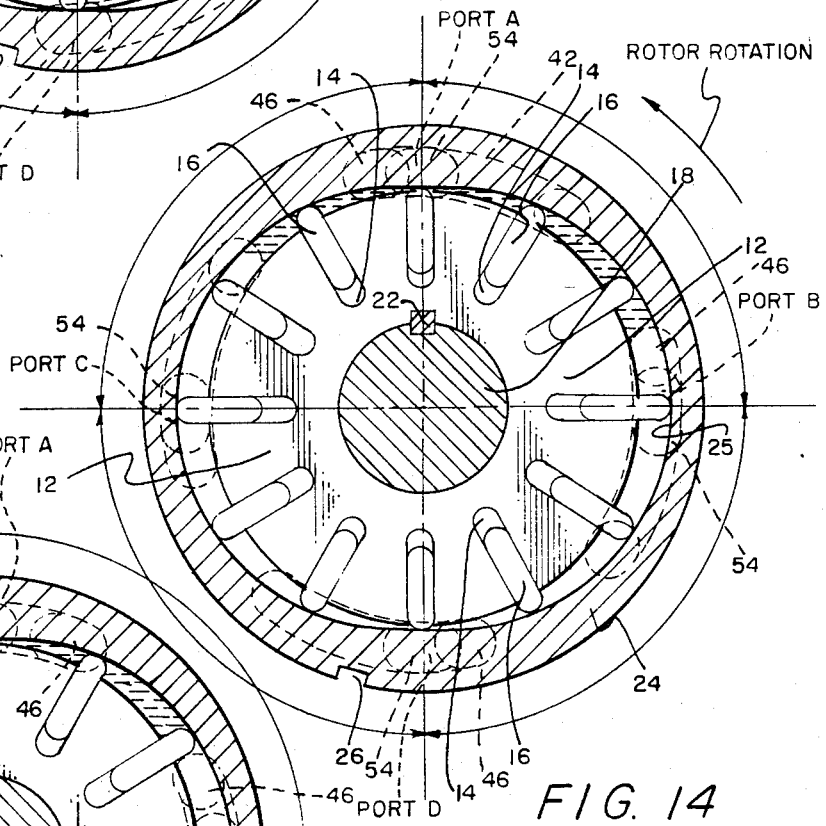
FIG. 14 is a vertical, sectional view disclosing the rotary valve plate rotated 12° in the clockwise direction.
Figure 15:
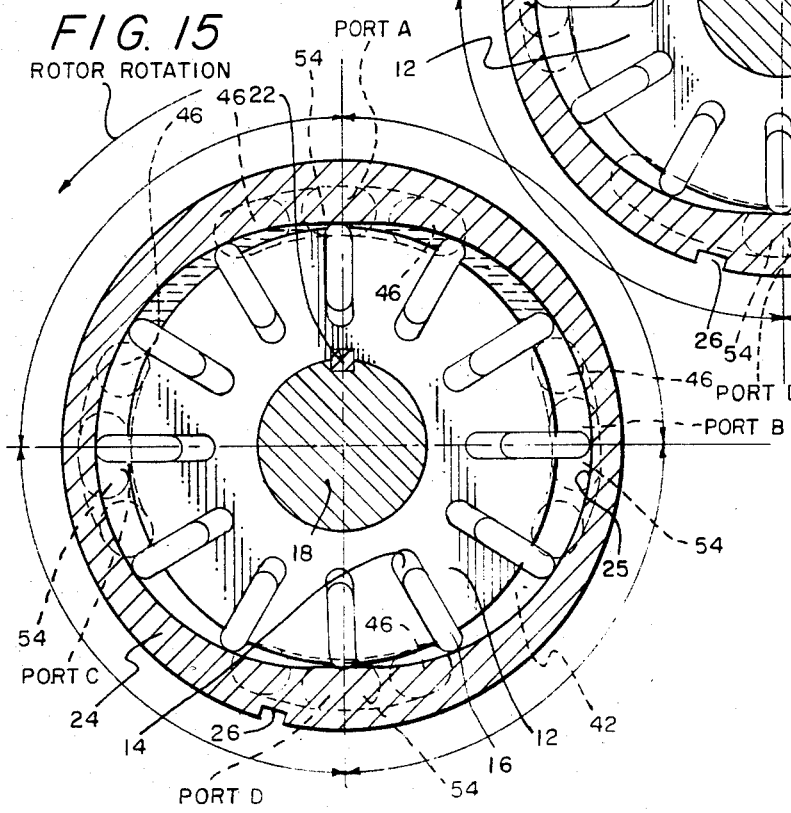
FIG. 15 is a vertical, sectional view disclosing the rotary valve in the neutral, or 0° rotation position. No fluid will be pumped with the valve in the 0° position.

With continuing reference to the drawings for operation of the invention and the method of pumping fluids with the vane pump 10, particularly FIGS. 8, 12, 13, 14 and 15, a rotary valve plate 42 is installed between the rotor 12 cam ring 24 combination and the elongated ports 54 of the rear bearing plate 43. As the rotor 12 is turned by the shaft 18 within the cam ring 24 the vanes 16 are forced to follow the surface 25. Since surface 25 is an elongated, circular shape cavity (1) and cavity (2) are formed between the rotor 12 and cam ring 24. The caming action that results on the vanes causes areas in increasing or decreasing volume to form between the vanes. This results in a pumping action, since any fluid present in the grooves 44 of valve 42 will be either drawn into or expelled from the areas of increasing or decreasing volume in cavities (one) or (two). The flow rate of the vane pump 10 is a function of the angular relationship between the valve port 46—46 of each pair of grooves 44—44 and cavities one (1) and two (2) (see FIG. 8) situated between the rotor 12 and the cam ring 24. The rotary valve plate 42 has four (b 4) identical pair of opposed grooves 44—44 and each side of its structure (including pair of ports 46—46 in each pair of structurally opposed grooves 44—44 which are arranged in a symmetrical pattern in FIG. 10. The rotary valve plate 42 can be rotated approximately 30 degrees either in a clockwise or counterclockwise direction by the control shaft 60-gear 58 combination; the exact amount of rotation available is a function of the design of the vane pump 10. Ports A and D, 54—54, of rear bearing plate 43 are externally in communication, as well as ports B-54 and C-54 (see FIG. 15 wherein elongated apertures 54—54—54—54 have been labeled "port A", "port B", "port C" and "port D"). With the rotary valve plate 42 positioned as shown in FIG. 15, and assuming the fluid is present in all ports A, B, C and D from same external source, the vane pump 10 will transfer no fluid in any direction because ports A-54 and ports D-54 (externally communicating and/or connected) are centered contiguously over grooves 44—44 and about the point where the cam ring 24 touches the rotor 12. This will cause the fluid pumped out of cavity two (2) (see FIG. 8) to be exactly used up to supply cavity one (1) at port A-54, with the opposite situation occuring at port D-54. In the case of the two pair of opposed grooves 44—44 symmetrically positioned over ports B-54, C-54 and centered over the maximum cavity width between the cam ring 24 and the rotor 12, the fluid pumped out of the decreasing areas of cavities one (1) and two (2) will be demanded by the increasing areas of cavities one (1) and two (2). With the rotary valve plate 42 in this neutral position fluid will be freely circulated within the vane pump 10 cavities one (1) and two (b 2) and none will be moved through the pump 10.

If the rotary valve plate 42 is rotated about 12 degrees counterclockwise as illustrated in FIG. 12, ports A-54, D-54 via overlapping rotated opposed grooves 44—44 and ports 46—46, overlap more of the increasing volume area of the cavities one (1) and two (2) than the decreasing areas. Likewise ports B-54, C-54 overlap more of the decreasing area than the increasing area. Some fluid will still be circulated within the vane pump 10, but some will be forced out of ports B-54, C-54 of the rear bearing plate 43; and due to symmetry, an equal amount of fluid will be demanded at ports A-54 and D-54. The volume demanded will be the difference between the volumes shown as shaded areas to the right and left of port A in cavity (1) and (2). Thus, when the rotary valve plate 42 is rotated as illustrated in FIG. 12, the vane pump 10 pumps fluid that has a volume which is a function of the location of the rotary valve plate 42 including its grooves 44—44 and ports 46—46.

As the ports 46—46 and the valve plate 42 are further rotated in the counterclockwise direction as illustrated in FIG. 13, the vane pump 10 delivers more fluid through ports B-54, C-54 of rear bearing plate 43 up to its maximum limit. If the rotary valve plate 42 is rotated in the clockwise direction as illustrated in FIG. 14, the ports A-54, B-54, C-54 and D-54 overlap the increasing and decreasing areas of the cavities one (1) and two (2) in precisely the same manner as with the couterclockwise rotation, but the direction of the fluid being pumped has been reversed and fluid is being pumped out of ports A-54, D-54 and demanded at ports B-54, C-54. Thus, by rotating the rotary valve plate 42, my vane pump 10 becomes a variable displacement, reversible flow pump and exceeds any present variable displacement pump now on the market in smoothness of operation, inexpensive construction, longevity and low maintenance.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A variable fluid flow and reversible directions fluid flow vane pump used to pump a fluid, comprising;

(a) a rotor means including a plurality of spaced rotor slots circumscribing the periphery of said rotor means;

(b) a vane means radially slidably mounted within each said rotor slots and radially variably extending beyond said periphery of said rotor means when biased by a force;

(c) a power take off means connected to said rotor means to rotate same;

(d) a cam ring means having an inside surface of an elongated curved shape;

(e) said rotor means rotatably mounted within said cam ring means and said vane means engaging said inside surface of said cam ring menas.

(f) a rotary valve plate means mounted against said cam ring means and said rotor;

(g) said rotary valve plate means including (1) a pair of arcuate grooves; (2) at least one port in each of said grooves; and (3) valve movement means;

(h) a case means encasing said cam ring means;

(i) a front bearing plate means connected to said case means to enclose one end thereof;

(j) a rear bearing plate means connected to said case means to enclose another end thereof;

(k) said rear bearing plate having apertures in fluid flow communication with respective ones of said grooves and said ports of said rotary valve plate means;

(l) a control means operably connected to said valve movement means to selectively rotate said rotary valve plate means relative to said cam ring means and said rotor means;

(m) said rotary valve plate means selectively rotatable to (1) a first position to direct all of the fluid in said arcuate grooves within said arcuate grooves with no fluid directed to or received from said apertures;

(2) a second position to direct a variable fluid flow output through one of said apertures; and (3) a third position to direct a variable fluid flow output through the other one of said apertures being a reversed fluid flow relative to said second position;

(n) said rotary valve plate means having four of said grooves on opposite sides thereof; and (o) pairs of said grooves directly opposed to each other and each of said pairs of said grooves connected to a respective one of said apertures.

* * * * *